United States Patent [19]

Eastep

[11] 4,410,791

[45] Oct. 18, 1983

[54] ELECTRIC INSTANT WATER HEATER

[75] Inventor: Calvin W. Eastep, Houston, Tex.

[73] Assignee: Kowah, Inc., Houston, Tex.

[21] Appl. No.: 298,649

[22] Filed: Sep. 2, 1981

[51] Int. Cl.[3] ..... F24H 1/10; H05B 3/24; H05B 3/82

[52] U.S. Cl. ..... 219/307; 219/298; 219/299; 219/305; 219/320; 219/368; 219/374; 219/376; 219/382

[58] Field of Search ..... 219/296–299, 219/302, 305–309, 320, 321, 374–376, 381, 382, 368

[56] References Cited

U.S. PATENT DOCUMENTS

| | | | |
|---|---|---|---|
| 793,118 | 6/1905 | Wright et al. | 219/307 |
| 1,396,121 | 11/1921 | Jacobsen | 219/298 X |
| 1,562,261 | 11/1925 | Sechowski | 219/374 X |
| 1,731,058 | 10/1929 | Pierson | 219/305 X |
| 1,899,839 | 2/1933 | Von Ruden | 219/298 X |
| 1,905,439 | 4/1933 | Carleton | 219/307 |
| 1,920,049 | 7/1933 | Arber | 219/298 X |
| 1,965,208 | 7/1934 | Ackerman | 219/306 |
| 1,985,830 | 12/1934 | Hynes | 219/296 X |
| 2,489,205 | 11/1949 | Sweeney | 219/368 X |
| 2,866,884 | 12/1958 | Minier | 219/306 |

FOREIGN PATENT DOCUMENTS

| | | | |
|---|---|---|---|
| 650855 | 10/1937 | Fed. Rep. of Germany | 219/307 |

*Primary Examiner*—A. Bartis

*Attorney, Agent, or Firm*—Brady, O'Boyle & Gates

[57] ABSTRACT

An electric instant water heater mounted in a cold water line in proximity to a water tap includes an elongated core molded from a ceramic material and having a rectangular cross-section water flow passage extending therethrough from a circular inlet connected to a water supply pipe to a circular outlet connected to the water tap. A plurality of parallel, spaced, thin rectangular electrical resistance heating plates are positioned within the passage with one rolled edge of each plate being embedded in the core on one side of the passage way and the opposite rolled edge of each plate extending freely into the passage. A plurality of projections molded integrally with the core extend from the opposite side of the passage into the spaces between the heating plates and terminate short of the one side of the passage to define with the plates a serpentine flow path from the inlet to the outlet to cause water to be heated to flow across each face of the heating plates. The core is thermally insulated and a thermal overheat switch is provided to control energization of the heater plates.

6 Claims, 5 Drawing Figures

ELECTRIC INSTANT WATER HEATER

BACKGROUND OF THE INVENTION

Heretofore, various electric water heaters have been proposed for installation adjacent the water tap to thereby provide instant hot water at the tap rather than from a hot water tank at a location remote from the tap. While these water heaters have been satisfactory for their intended purposes, they have been characterized by certain objections in that some heaters were constructed and arranged in such a manner that a flow path was not provided to cause the water to be heated efficiently by the heating elements. In other heaters, provided with baffles to provide the necessary flow path, the heating elements consisted of coiled resistance wires positioned in the flow path which resulted in an obstruction of the flow of water through the heater.

After considerable research and experimentation, the electric instant water heater of the present invention has been devised to overcome the disadvantages experienced heretofore in electric water heaters, and comprises, essentially, a plurality of spaced, parallel, plate-like resistance elements mounted within a core having a plurality of tapered projections extending into the spaces between the resistance elements to form a serpentine flow path wherein the water to be heated is caused to flow across each face of the heating elements. The flow path in the core extends from a circular inlet, adapted to be connected to a standard pipe, which path then expands into an elongated flow area containing the heating elements and tapered projections, and then to a reduced area at a circular outlet connected to a conventional pipe communicating with a water tap. By this construction and arrangement, an unrestricted flow passage is provided whereby the water flow therethrough is heated quickly and efficiently.

DESCRIPTION OF THE PREFERRED EMBODIMENT

Figure 1:
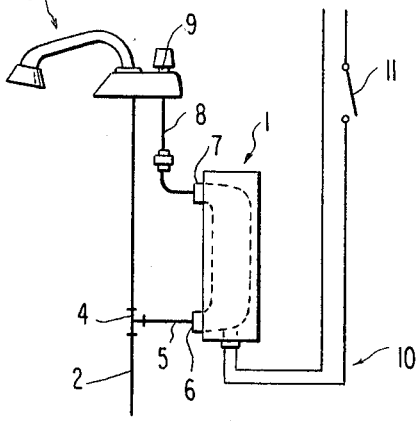
FIG. 1 is a diagrammatic view of the instant water heater in a plumbing installation.

Referring to the drawings and more particularly to FIG. 1 thereof, the water heater 1 of the present invention is adapted to be connected into a plumbing installation including a cold water inlet pipe 2 connected to a dual tap 3. The inlet pipe 2 is provided with a tee fitting 4 for connecting a cold water branch line 5 to the inlet 6 of the water heater. The outlet 7 of the water heater is connected to a hot water line 8 connected to the hot water valve 9 of the dual tap. Electrical power is supplied to the water heater 1 by a 115 volt a.c. service line 10 which includes a switch 11 mounted in proximity to the faucet control area.

Figure 2:
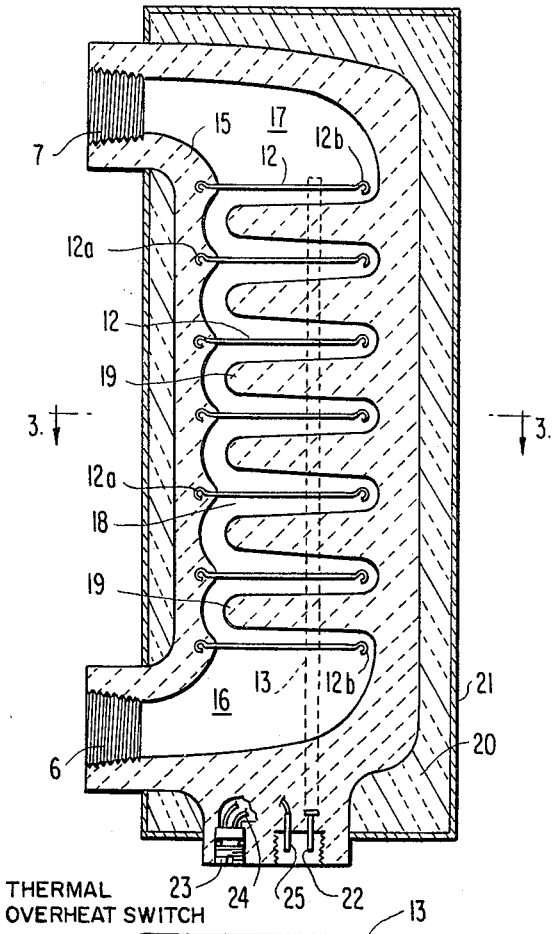
FIG. 2 is a side elevational view, in section, showing the details of the construction of the instant water heater of the present invention.
Figure 4:
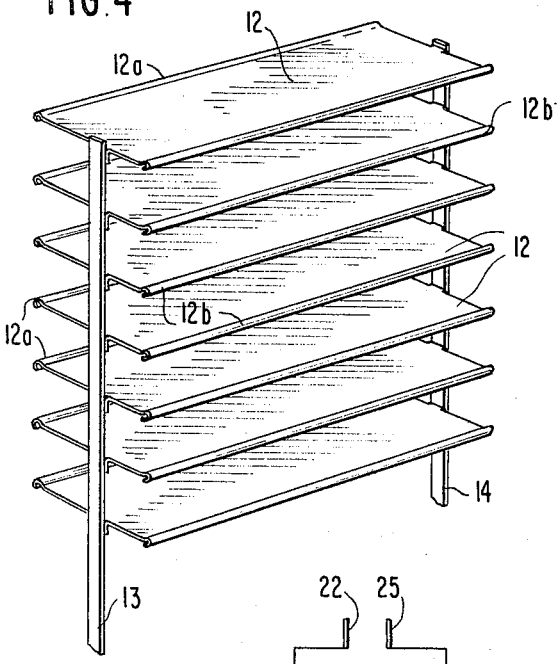
FIG. 4 is a perspective view of the heating plates employed in the water heater of the present invention.
Figure 3:
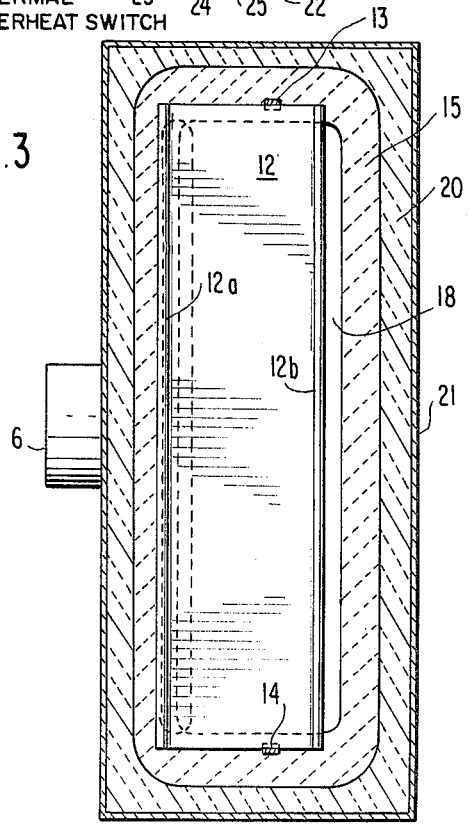
FIG. 3 is a view taken along line 3—3 of FIG. 2.

The details of the construction of the instant water heater of the present invention are shown in FIGS. 2, 3 and 4, wherein it will be seen that the heating elements for the water heater comprise a plurality of spaced, parallel, horizontally disposed plates 12 electrically connected to leads 13 and 14. The longitudinal edges of each plate are rolled as at **12*a* and 12*b* whereby the rolled edges 12*a* provide an anchorage for the plates when molded within a ceramic core 15, and the rolled edges 12*b* stiffen the free ends of the plates. The molded core 15 is provided with the circular inlet 6 and circular outlet 7 which communicate with flared passage areas 16 and 17, respectively, having an elongated passage 18** of rectangular cross-section extending therebetween.

The core is also provided with a plurality of tapered ceramic projections 19 extending into the passage 18 and the spaces between the plates 12. By having all of the plates 12 extending from one side of the core 15 into the flow passage 18, and by having all of the tapered projections 19 extending from the opposite side of the core into the passage 18 and into the spaces between the plates, a serpentine flow path is provided causing the water to be heated to flow across each face of the heating plates 12, whereby the water is heated quickly and efficiently.

To prevent heat loss, the exterior surface of the core 15 is provided with suitable insulation 20 enclosed by a cover 21.

Figure 5:
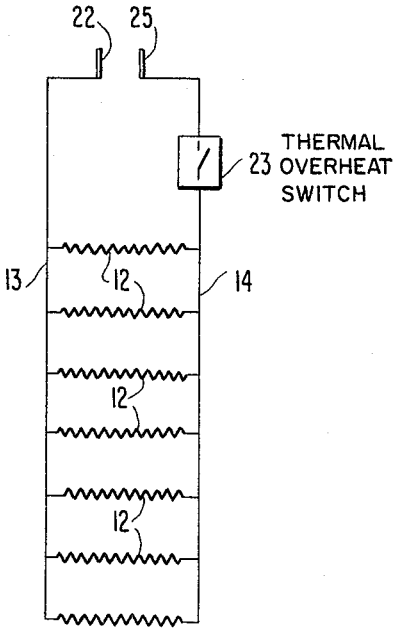
FIG. 5 is a schematic view of the electrical circuit containing the instant water heater.

As will be seen in FIGS. 2 and 5, the leads 13 and 14 extend through the core 15 with the lead 13 being connected to the connector pin 22, the lead 14 being connected to a thermal overheat switch 23. A second lead 24 is connected between the thermal overheat 23 and a second connector pin 25. By means of the connector pins 22, 25, the heating unit can be plugged into the service line 10.

In use, the switch 11 is closed whereby the heating plates are energized via the pins 22, 25 and leads 13 and 14 to thereby heat the water within the passage 18 of the core 15. When the hot water valve 9 is open, the hot water flows from the heater outlet 7 to the tap 3, while cold water enters the inlet 6. The water to be heated flows upwardly in a serpentine path and across each face of the respective heating plates so that, when the water flows through the outlet 7, it has been raised to the desired temperature. If the water should become heated to a temperature above the desired temperature, the thermal overheat 23 will open to thereby de-energize the plates 12.

It will be understood by those skilled in the art that the switch 11 can be electrically connected to the valve 9 or to a light switch or other auxiliary component so that when the component is actuated, the switch 11 will simultaneously close.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An electric instant water heater comprising a core having a passage extending therethrough, a cold water inlet connected to one end of said passage, a hot water outlet connected to the opposite end of said passage, a plurality of parallel, spaced, heating plates positioned within said passage, one edge of each plate being connected to the core on one side of said passage, the opposite edge of each plate extending freely within said passage, a plurality of projections connected to said core on the opposite side of said passage and extending into said passage and the spaces between said heating plates, said core consisting of a molded refractory material, said one edge of each heating plate being embedded within the core, said projections being of molded refractory material integrally formed with said core, said one edge of each heating plate being rolled to provide an anchorage for the edge embedded in the refractory core, the opposite edge of each plate being rolled to thereby stiffen the free edges of the plates, and electrical circuit means connected to said heating plates, whereby the heating plates and projections form a serpentine flow path within the passage to thereby cause water to be heated to flow across each face of the heating plates.

2. An electric instant water heater according to claim 1, wherein the water inlet and outlet are circular in cross-section for connecting to standard pipes, said passage being rectangular in cross-section and extending longitudinally of the core, flared passage areas provided at each end of said passage communicating with the respective inlet and outlet.

3. An electric instant water heater according to claim 1, wherein the molded refractory material is ceramic.

4. An electric instant water heater according to claim 3, wherein the exterior surface of the core is provided with insulation to prevent the loss of heat through the core.

5. An electric instant water heater according to claim 1, wherein said electrical circuit means comprises, a pair of leads electrically connected to said heating plates, one of said leads terminating in a connector pin, the other of said leads being connected to a overheat switch, a third lead being connected between said overheat switch and a second connector pin, said connector pins being plugged into a 115 volt A.C. service line.

6. An electric instant water heater according to claim 1, wherein the water heater is positioned in proximity to a water tap, the cold water inlet of the heater communicating with the cold water pipe to the tap, the hot water outlet of the heater communicating with the hot water valve of the water tap.

* * * * *